US005678467A

United States Patent [19]

Aigner

[11] Patent Number: 5,678,467

[45] Date of Patent: Oct. 21, 1997

[54] EXCHANGEABLE HANDLE FOR WOODEN PUSHERS

[76] Inventor: Georg Aigner, Thannenmais, Reisbach, Germany, 94419

[21] Appl. No.: 454,211

[22] PCT Filed: Aug. 16, 1994

[86] PCT No.: PCT/EP94/02727

§ 371 Date: Jun. 9, 1995

§ 102(e) Date: Jun. 9, 1995

[87] PCT Pub. No.: WO95/11785

PCT Pub. Date: May 4, 1995

[30] Foreign Application Priority Data

Oct. 28, 1993 [DE] Germany ..... 43 36 719.4

[51] Int. Cl.[6] ..... B27B 25/10

[52] U.S. Cl. ..... 83/436.2; 83/437.2; 144/245.1; 144/245.6

[58] Field of Search ..... 83/423, 425, 401, 83/435.1, 437, 707, 436.2, 437.2; 144/245.1, 245.6

[56] References Cited

U.S. PATENT DOCUMENTS

| | | | |
|---|---|---|---|
| 2,696,852 | 12/1954 | Dunton | 83/435.1 |
| 2,839,100 | 6/1958 | Valicenti | 294/15 |
| 4,164,882 | 8/1979 | Mericle | 83/435.1 X |
| 4,348,925 | 9/1982 | Manweiler | 83/435.1 |
| 4,370,909 | 2/1983 | Jennings | 83/437 |
| 5,113,734 | 5/1992 | Mahler | 83/437 X |

FOREIGN PATENT DOCUMENTS

| | | |
|---|---|---|
| 4410 | 9/1918 | Netherlands . |

*Primary Examiner*—Rinaldi I. Rada
*Assistant Examiner*—Raymond D. Woods
*Attorney, Agent, or Firm*—Cohen, Pontani, Lieberman, Pavane

[57] ABSTRACT

An exchangeable handle for wooden pushers which handle includes a grip having a base plate which is L-shaped in cross section, this base plate having a long leg and a short leg in which spikes are provided for driving into the wooden pusher. The spikes attached to the short leg project at right angles from the short leg and extend parallel to the long leg. The spikes provided at the free end of the long leg are attached to a swivel lever which is rotatable about a shaft. The spikes which project out of the long leg through openings therein can be swiveled by an actuating lever from a direction substantially parallel to the sort leg into an engagement position at an angle thereto.

8 Claims, 4 Drawing Sheets

EXCHANGEABLE HANDLE FOR WOODEN PUSHERS

FIELD OF THE INVENTION

The invention is directed to an exchangeable handle for wooden pushers, which handle has a grip that is fastened at a base plate which is L-shaped in cross section and has a long leg and a short leg in which spikes are provided for driving into the wooden pusher. The spikes attached to the short leg project at right angles from the short leg and extending parallel to the long leg.

DESCRIPTION OF THE PRIOR ART

When cutting small workpieces in wood cutting machines using manual guidance, wooden pushers are used to guide the workpiece past the tool and to press the workpiece against a stop or withdraw it from the tool. This pusher prevents the hand of the operator from entering the immediate vicinity of the tool, thus avoiding the possibility of injury. When working with machine tools such as cutting machines, planing machines, circular saws or band saws, the wooden pushers regularly enter the working area of the tool so that they are subject to severe wear and must be replaced often. Wooden pushers in a wide variety of shapes are available for different work processes and are used by the woodworker as the need arises. The exchangeable handle mentioned above, which can be attached to the wooden pusher by its spikes in a relatively simple manner, is used for exchange and simple handling of the wooden pushers.

In an exchangeable handle constructed in the manner described above, the spikes for engaging in the wooden pusher are rigidly attached to the short leg and also the long leg of the L-shaped base plate. A leaf spring is attached in a rotatable manner to a cheek projecting down from a longitudinal side of the long leg. At its free end, this leaf spring carries another spike which must be pressed, through a bore hole in the cheek, into a narrow side of the wooden pusher. Due to their arrangement at a fixed angle of 90°, the rigid spikes are at risk of breaking off easily when fastened to or removed from the wooden pusher, for which reason they are designed to be exchangeable. The spike attached to the leaf spring especially can be bent easily so that it no longer engages in the bore hole of the cheek but, rather, contacts the cheek next to the bore hole. Due to the lateral cheek projecting from the long leg of the base plate, two different exchangeable handles must be available, depending on whether the stop of the machine tool is located to the right or to the left of the workpiece. Finally, a tool is required to pull the leaf spring into the disengaged position.

SUMMARY OF THE INVENTION

The object of the present invention is to provide a universally applicable exchangeable handle for wooden pushers which can be used for any kind of job at an optimal position on the wooden pusher in every case and can be fastened to the wooden pusher required in a given case merely by a few manual adjustments without requiring tools or the delivery of blows.

In an exchangeable handle of the generic type outlined above, this object is met according to the invention in that the spikes provided at the free end of the long leg are fastened to a swivel lever which is rotatable about a shaft.

Since the exchangeable handle according to the invention has no cheek projecting down on either of its longitudinal sides, it may be fastened to the wooden pusher on the right or left side or in the center. The spikes fastened to the swivel lever are driven into the wooden pusher from above when the swivel lever is actuated and, in so doing, draw the spikes projecting at the short leg into the wooden pusher so as to achieve a very fast and stable fastening of the handle at the wooden pusher. There is no risk of breaking or bending of spikes since all spikes are loaded only in the direction of their longitudinal axis, but not transversely thereto.

The swivel lever is fastened in a stationary manner with an actuating lever whose free end preferably faces the short leg of the base plate. Accordingly, the actuating lever does not project out so as to impede work in which the exchangeable handle must be moved very close to the protective shield or the like.

According to another feature of the invention, the spikes projecting out of the long leg through openings in the latter can be swiveled by means of the actuating lever from a direction substantially parallel to the short leg into an engagement position at an angle thereto.

Further features and advantages of the invention will appear from the following description of embodiments which are shown in the drawing.

DETAILED DESCRIPTION OF THE PREFERRED EMBODIMENTS

Figure 1:
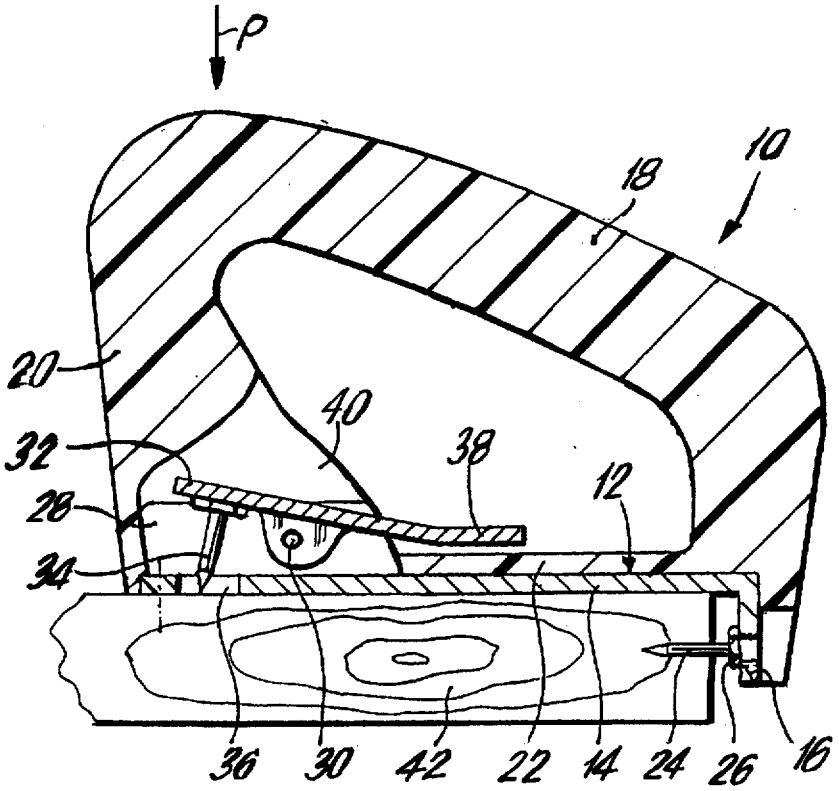
FIG. 1 shows a longitudinal section through an exchangeable handle pursuant to the present invention before the spikes provided at the long leg are swiveled into a wooden pusher.
Figure 2:
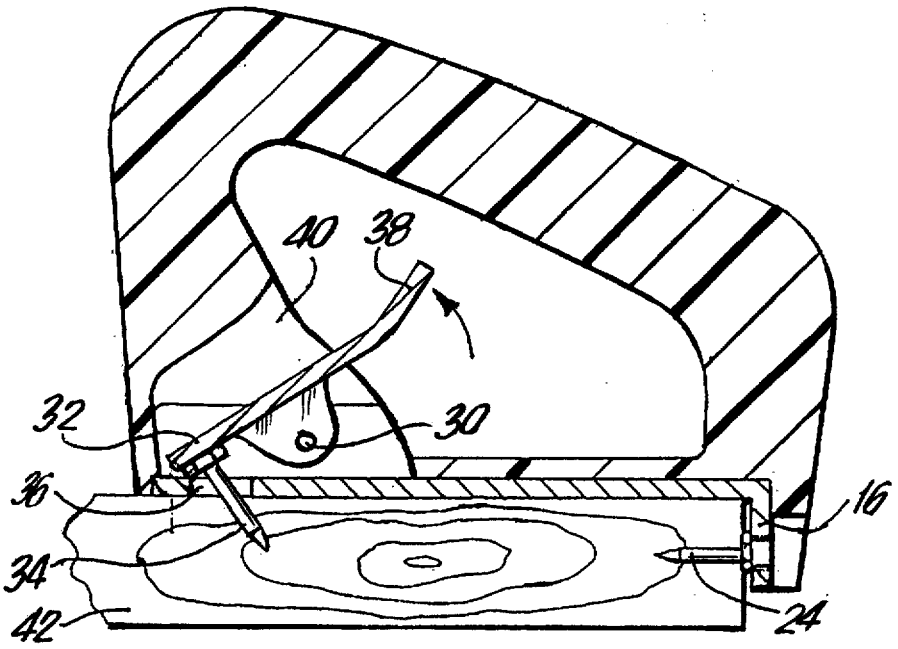
FIG. 2 is a sectional view corresponding to FIG. 1 showing the exchangeable handle fastened to the wooden pusher.
Figure 3:
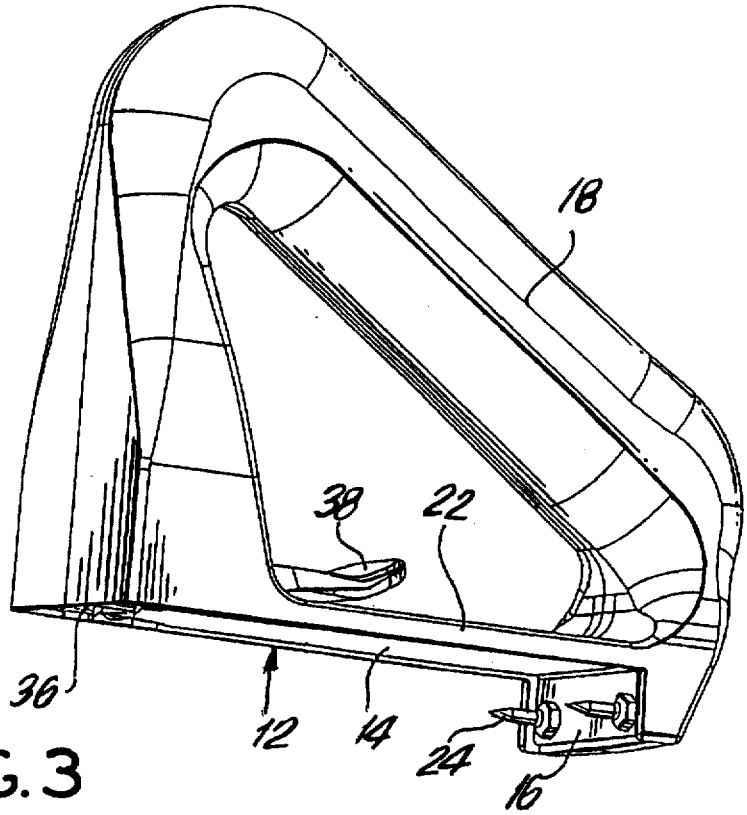
FIG. 3 shows a perspective view of the exchangeable handle in the position shown in FIG. 1.
Figure 4:
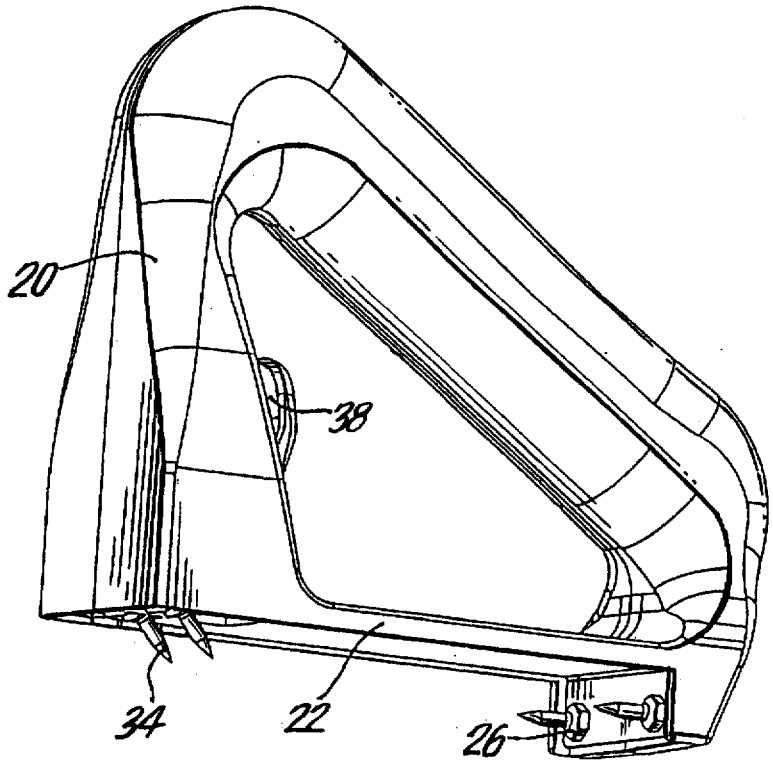
FIG. 4 shows a perspective view of the exchangeable handle in the position according to FIG. 2.
Figure 5:
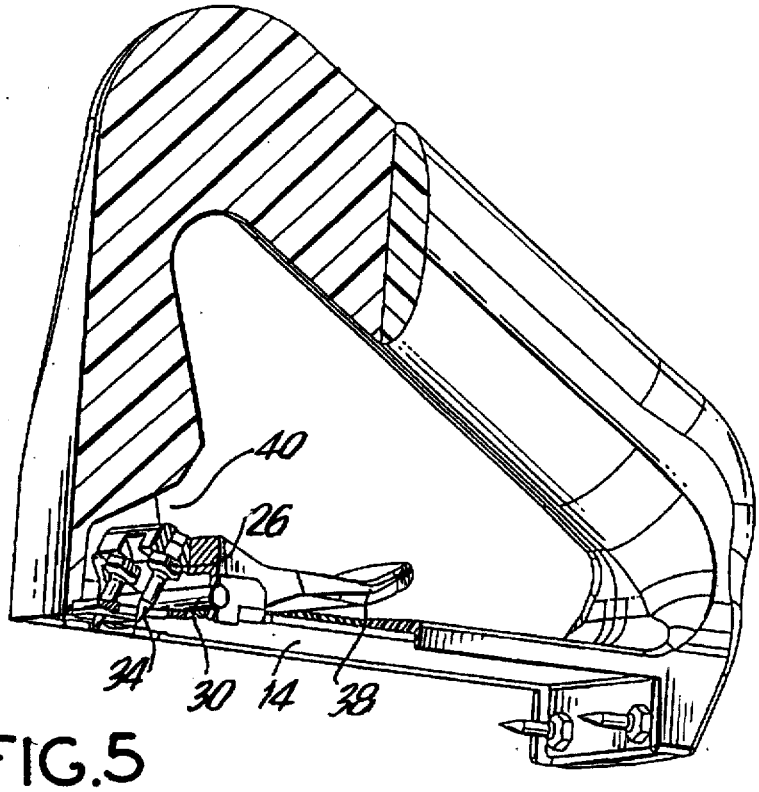
FIG. 5 is a partial sectional view of the exchangeable handle in the position shown in FIGS. 1 and 3.
Figure 6:
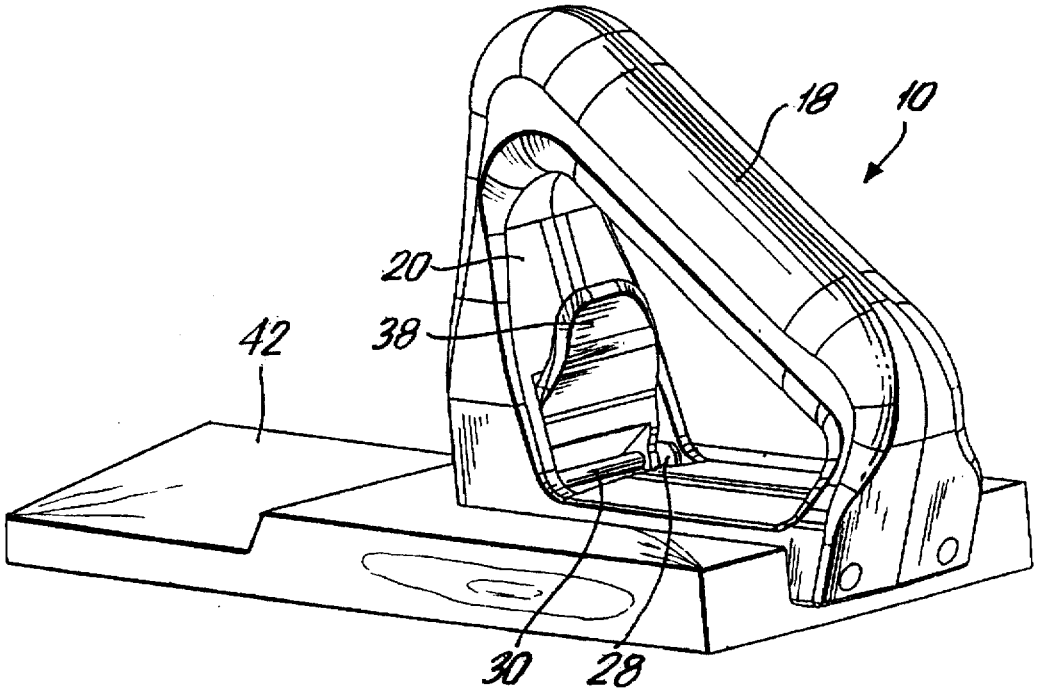
FIG. 6 shows a perspective view of the exchangeable handle in the position shown in FIG. 2.

The construction and use of an exchangeable handle 10 according to the invention will be clear from FIGS. 1 and 2. A metal base plate 12 which is L-shaped in cross section has a long leg 14 and a short leg 16 which projects down at a fight angle from one end of the long leg 14. A plastic grip 18 is attached to the metal base plate 12 and is shaped in such a way that it can be comfortably grasped in the hand. The two ends of the grip 18 pass into a U-shaped handle 20 whose bottom part 22 is screwed to the base plate 12.

Two spikes 24 are attached to the short leg 16 of the base plate 12. These spikes 24 project at right angles from the short leg 16 in the direction of the free end of the long leg 14 and extend parallel to the latter. Each spike 24 is screwed into a threaded bore hole of the short leg 16 by means of a hexagon wrench 26 so as to be exchangeable and serves at the same time to fasten the handle 20 at the base plate 12.

Two side walls 28 project upward from the free end of the long leg 14 and engage between the inside walls of a recess 40 cut out of the handle 20. A shaft, 30, to which a swivel lever 32 is fastened, is supported so by the two side walls 28 extending parallel to one another, so as to be freely rotatable. The swivel lever 32 extends from the shaft 30 in the direction of the free end of the long leg 14 and carries two spikes 34 at its lower side. These two spikes 34 are constructed and fastened in the same manner as spikes 24, namely so as to be exchangeable. The spikes 34 project downward out of the base plate 12 through openings 36 in the long leg 14 of the base plate 12. The swivel lever 32 is connected integral with an actuating lever 38 which is situated on the other side of the shaft 30 and, in the example shown in FIGS. 1 to 6, projects through the cut out recess 40 of the handle 20 in the direction of the long leg 14.

Alternatively, for the purpose of supporting the shaft 30, bushings can be inserted in the side walls of the handle 20 which define the cut out recess 40 so that the side walls 28 of the long leg 14 are dispensable.

Figure 7:
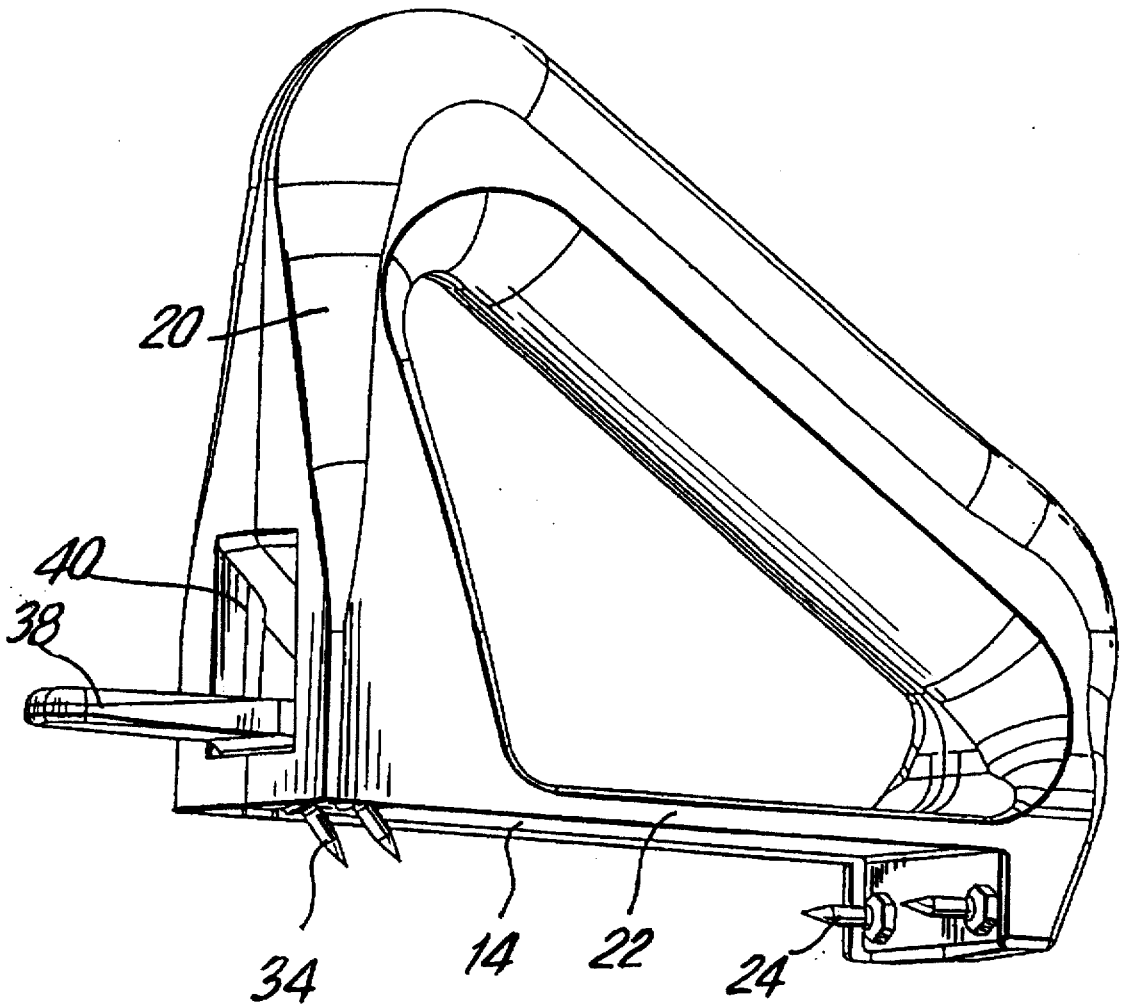
FIG. 7 shows a perspective view of another embodiment of the exchangeable handle.

In the embodiment shown in FIG. 7, the swivel lever 32 and actuating lever 38 are one in the same, since they lie on the same side of the shaft 30. In this case, the recess 40 is cut out of the front side of the handle 20. The actuating lever 38 projects out of the latter recess 40 in the opposite direction to that shown in FIGS. 1 to 6.

To connect the exchangeable handle 10 with a wooden pusher 42, the base plate 12 is first placed flat on the wooden pusher 42 with the spikes 34 in the position shown in FIG. 1, whereupon the two spikes 24 of the short leg 16 are pressed into the end side of the wooden pusher 42. No tools are needed for this.

Next, pressure p is applied manually to the part of the grip 18 situated over the shaft 30, while pulling the actuating lever 38 up with the other hand. In this way, the two spikes 34 are pressed into the wooden pusher 42 via the swivel lever 32 from the position shown in FIG. 1 into the position shown in FIG. 2 so that the short leg 16, together with the two spikes 24, is pulled completely into the end face of the wooden pusher 42. The position shown in FIG. 2, in which the spikes 34 are swiveled into an engagement position at an angle to the short leg 16, is reached in this way. In this position, the exchangeable handle 10 is reliably fixed on the wooden pusher 42 so that the desired job can be carried out.

When the wooden pusher 42 is used up or must be changed, the exchangeable handle 10 is removed and fastened to a new wooden pusher. For this purpose, the actuating lever 38 is pressed down again so that the swivelable spikes 34 are pulled upward out of the wooden pusher 42 and the wood pusher 42 can be pulled away from the spikes 24.

The invention is not limited by the embodiments described above which are presented as examples only but can be modified in various different ways with in the scope of protection defined by the appended patent claims.

I claim:

1. An exchangeable handle for a wooden pusher, comprising:

an L-shaped base plate having a long leg and a short leg;

a first plurality of spikes mounted to the short leg so as to project at a right angle from the short leg and extend parallel to the long leg, whereby the first plurality of spikes are driveable into the wooden pusher;

a grip connected to the base plate;

a second plurality of spikes provided at a free end of the long leg; and lever means for mounting the second plurality of spikes to the free end of the long leg so that the second plurality of spikes are movable about an axis into and out of the wooden pusher, the lever means including a shaft provided at the free end of the long leg and a swivel lever provided so as to rotate about the shaft, the second plurality of spikes being mounted at one end of the swivel lever.

2. An exchangeable handle according to claim 1, wherein the lever means further includes an actuating lever having one end fixed to a second end of the swivel lever.

3. An exchangeable handle according to claim 2, wherein the actuating lever has a second, free end, the actuating lever being arranged so that the second, free end of the actuating lever faces toward the short leg.

4. An exchangeable handle according to claim 2, wherein the long leg has through openings provided at the free end so as to permit the second plurality of spikes mounted to the swivel lever to pass therethrough, the lever means being operative to move the second plurality of spikes between a disengaged position in which the second plurality of spikes are substantially parallel to the short leg and an engagement position in which the second plurality of spikes are at an angle to the short leg.

5. An exchangeable handle according to claim 1, and further comprising two sidewalls arranged at the free end of the long leg so as to extend in a direction opposite the short leg, the shaft being supported in the sidewalls.

6. An exchangeable handle according to claim 1, wherein the grip includes an integral handle portion that connects the grip to the base plate.

7. An exchangeable handle as defined in claim 6, wherein the handle portion has a recess in a region adjacent to the base plate, the shaft being arranged in the recess so that the swivel lever is disposed in the recess.

8. An exchangeable handle as defined in claim 1, wherein the first plurality of spikes are removably mounted to the short leg and the second plurality of spikes are removably mounted to the swivel lever.

* * * * *